US006278047B1

(12) United States Patent
Cumberland

(10) Patent No.: US 6,278,047 B1
(45) Date of Patent: Aug. 21, 2001

(54) APPARATUS FOR TUNING STRINGED INSTRUMENTS

(76) Inventor: Todd Cumberland, 3629 Serra Rd., Malibu, CA (US) 90265

( * ) Notice: Subject to any disclaimer, the term of this patent is extended or adjusted under 35 U.S.C. 154(b) by 0 days.

(21) Appl. No.: 09/543,512

(22) Filed: Apr. 6, 2000

(51) Int. Cl.[7] ..... G10G 7/02
(52) U.S. Cl. ..... 84/455; 84/734
(58) Field of Search ..... 84/454, 455, 458, 84/734

(56) References Cited

U.S. PATENT DOCUMENTS

| | | | |
|---|---|---|---|
| 4,023,462 | | 5/1977 | Denov et al. . |
| 4,228,715 | * | 10/1980 | Nourney . |
| 4,297,938 | | 11/1981 | Kirby . |
| 4,584,923 | | 4/1986 | Minnick . |
| 4,909,126 | | 3/1990 | Skinn et al. . |
| 4,958,550 | | 9/1990 | Kugimoto . |
| 5,009,142 | | 4/1991 | Kurtz . |
| 5,038,657 | * | 8/1991 | Busley . |
| 5,095,797 | | 3/1992 | Zacaroli . |
| 5,323,680 | | 6/1994 | Miller et al. . |
| 5,343,793 | | 9/1994 | Pattie . |
| 5,390,579 | | 2/1995 | Burgon . |
| 5,438,902 | * | 8/1995 | Baker . |
| 5,767,429 | | 6/1998 | Milano et al. . |
| 5,886,270 | * | 3/1999 | Wynn ..... 84/454 |

* cited by examiner

*Primary Examiner*—Jeffrey Donels
(74) *Attorney, Agent, or Firm*—Brian B. Shaw, Esq.; Stephen B. Salet, Esq.; Harter, Secrest & Emery

(57) ABSTRACT

A microprocessor-controlled tuning apparatus for a stringed instrument, wherein the tension of a string is detected by a sensor, compared with a reference value, and readjusted if necessary until the detected value conforms with the reference value, thereby achieving a corresponding musical pitch.

12 Claims, 4 Drawing Sheets

APPARATUS FOR TUNING STRINGED INSTRUMENTS

FIELD OF THE INVENTION

The present invention relates to an apparatus for tuning stringed instruments.

BACKGROUND OF THE INVENTION

In a stringed instrument, each string is extended with a predetermined tension between two critical contact points that primarily define the effective length of the string. The first critical contact point is generally at the bridge, which is provided on the body of the instrument. The second critical contact point is generally at the nut which, depending on the instrument, is usually positioned on the head or at a point of the neck distant from the body of the instrument. Both the tension and the effective length of the string determine its musical tone.

The distance between the bridge and the nut is the primary determinant of the effective length of a string. However, an instrumentalist can shorten the effective length during a musical performance, by depressing the string with a finger until it contacts any one of a plurality of frets that are positioned along the neck of the instrument between the nut and the bridge.

Vibrating the string generates a musical tone. In an instrument such as a guitar, a musical tone is conventionally obtained by plucking the string with a finger; in an instrument such as a violin, the musical tone is obtained by drawing a bow back and forth across the string.

A string that is extended with an improper tension and is extended for a distance of an improper string length may result in a generation of a musical tone of an incorrect sound frequency. Accordingly, each of the strings specially needs to be extended under a proper tuning state.

SUMMARY OF THE INVENTION

The present invention relates to an apparatus for tuning stringed instruments in which each of a plurality of strings is operably connected to a corresponding sensor and a tensioning driver. The sensor provides to a microprocessor controller a real time value of the tension in the corresponding string. A computer receives the real time tension value from the microprocessor and compares it with a predetermined reference value stored in the computer memory. Feedback information is provided to the microprocessor, which commands the driver to adjust the string tension accordingly.

In a preferred embodiment, the sensor that measures the string tension is a strain gauge. The operative component of a strain gauge is an electrically conductive element that is connected to the system whose tension is to be measured, and is thereby subjected to the same tension. The electrical conductivity of the element varies with tension in a known manner; it is determined by imposing a known voltage across the element, and measuring the resultant current. Since the musical pitch of a musical instrument is directly related to its tension, other factors being unchanged, the strain gauge therefore provides a simple means of tuning the instrument. The measurement of string tension may also be done using the conductivity of the strings themselves, if electrically conductive strings are used.

When, after time and repeated use, the string stretches and becomes looser, the microprocessor may compare the present value of the tension to the value in memory and command the driver to tighten the string back to the tension it possessed upon first being tuned.

The stored reference tuning values set by the user may be changed as desired. Further, multiple settings may be stored in the computer to allow a user to alter the tuning of the instrument as it is played.

A computer may be used having a wireless connection to the adjusting drivers on the instrument. In addition, plurality of instruments may be operably connected by the wireless communication to the operator, wherein each stringed instrument has its own channel of communication. The computer would coordinate actions among multiple instruments.

DETAILED DESCRIPTION OF THE INVENTION

Figure 1:
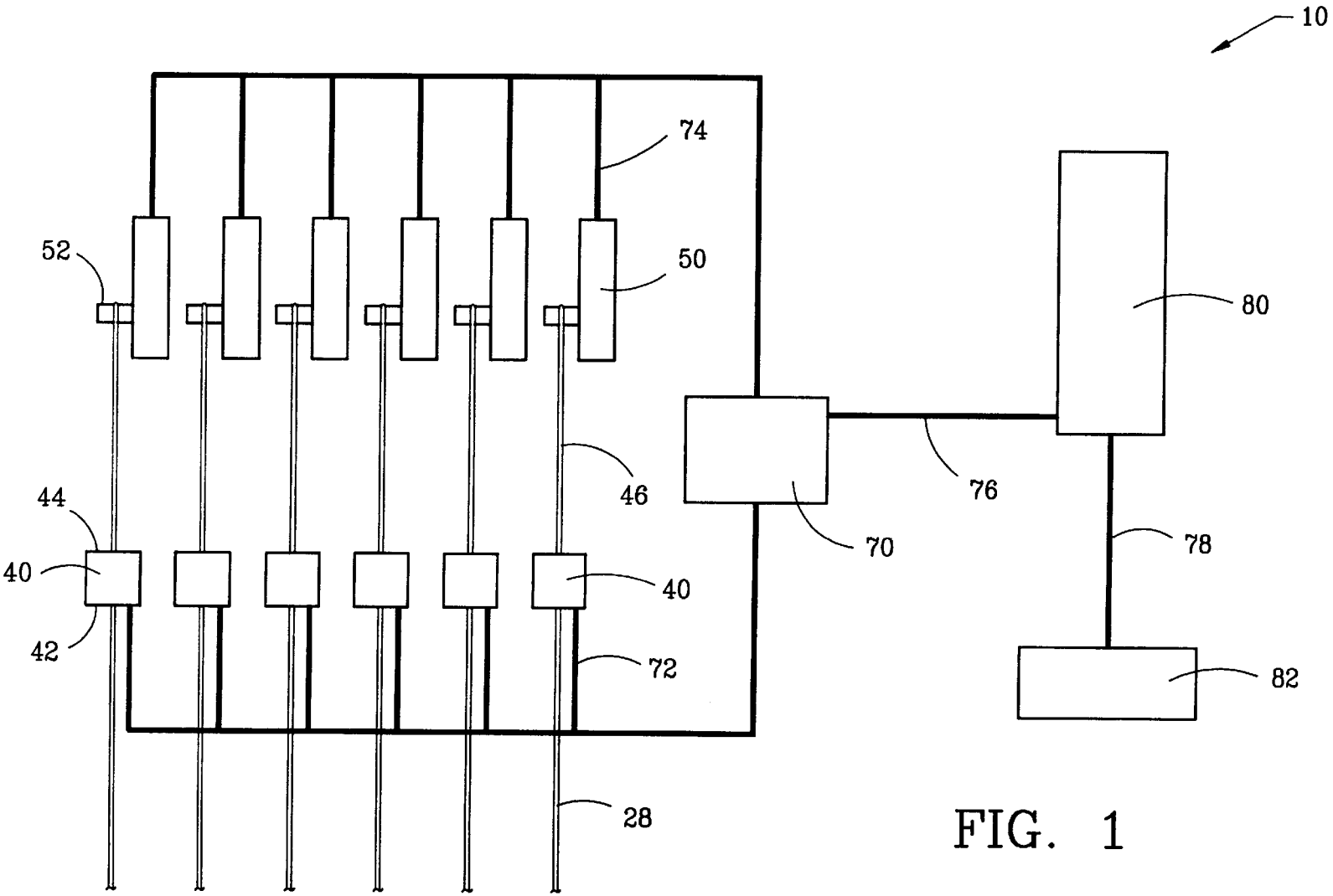
FIG. 1 is a schematic showing a tuning apparatus for a stringed instrument.
Figure 2:
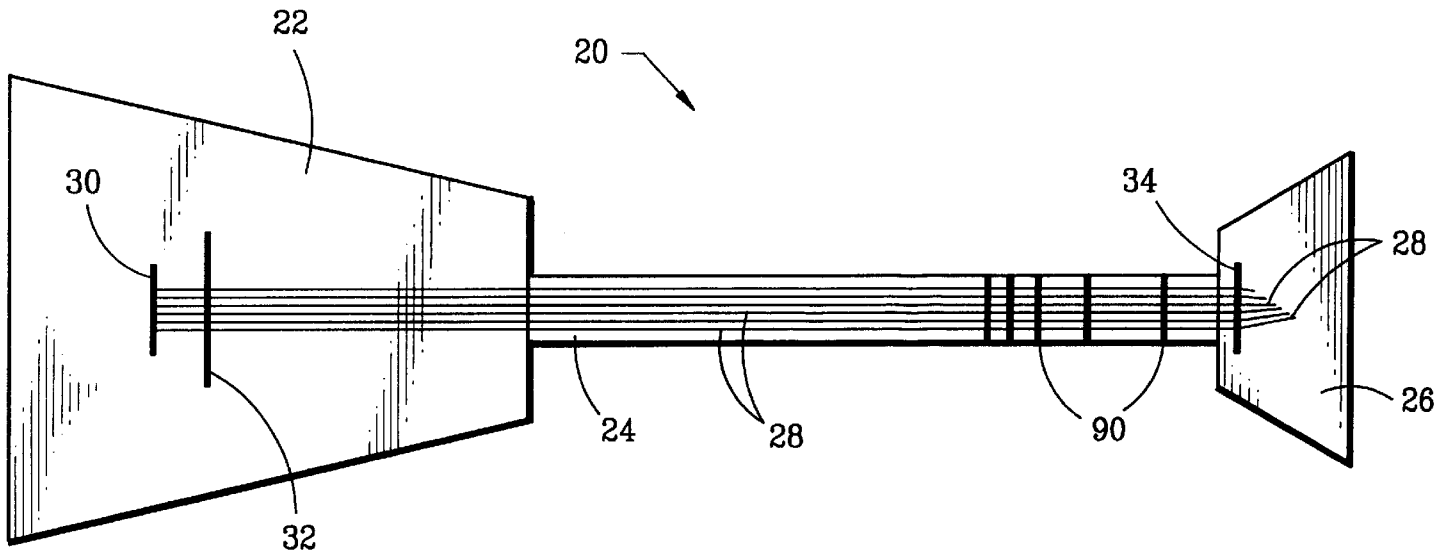
FIG. 2 is a schematic plan view of the stringed instrument, omitting the tuning apparatus.
Figure 3:
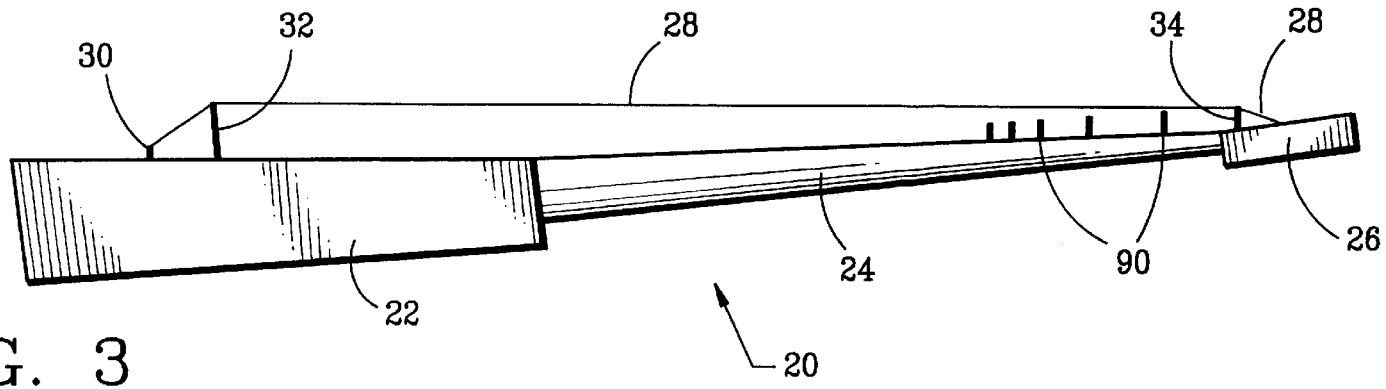
FIG. 3 is a schematic side elevation of the instrument of FIG. 2.
Figure 4:
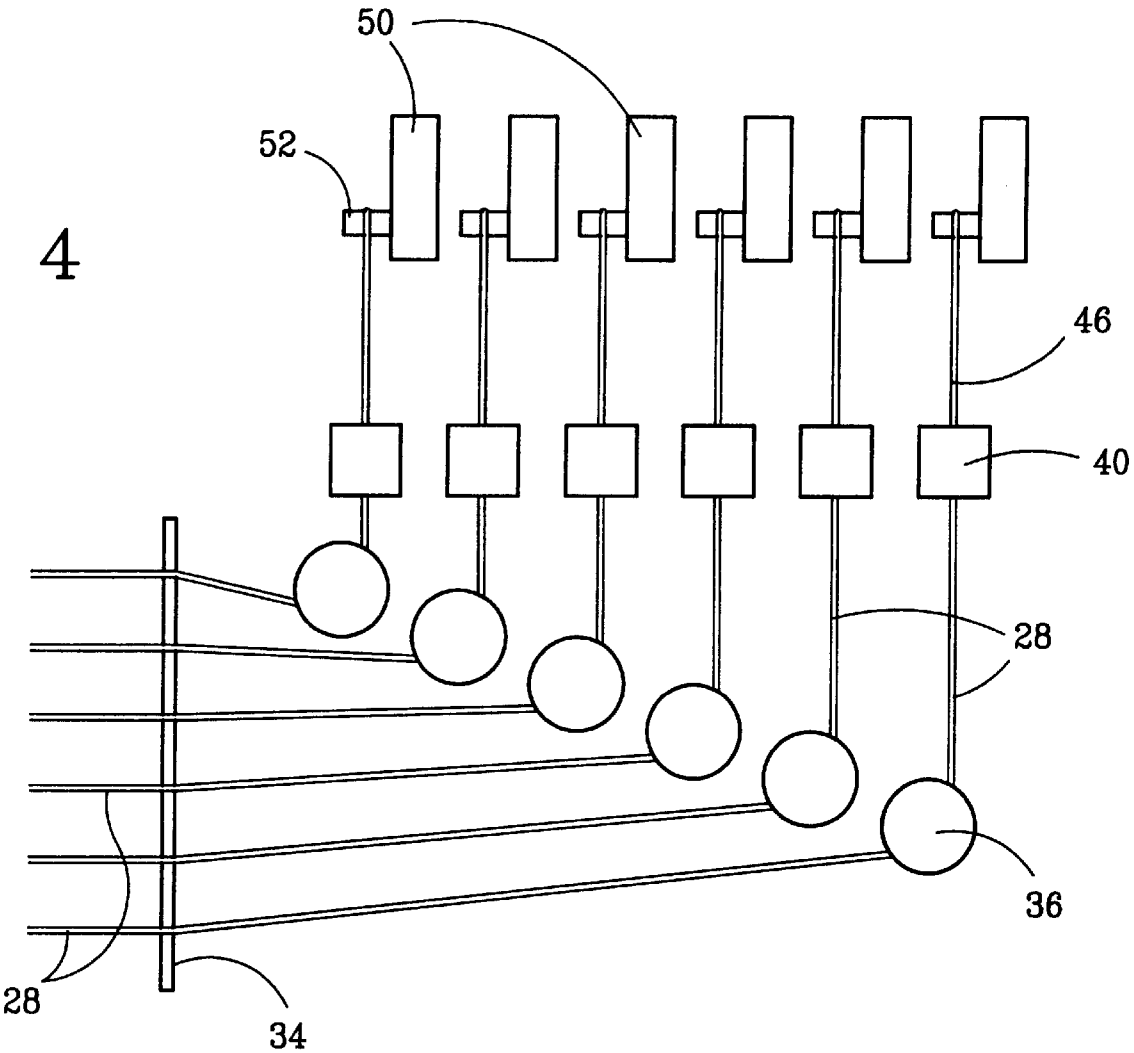
FIG. 4 is a schematic plan view of the strings of a stringed instrument, including elements of the tuning apparatus.
Figure 5:
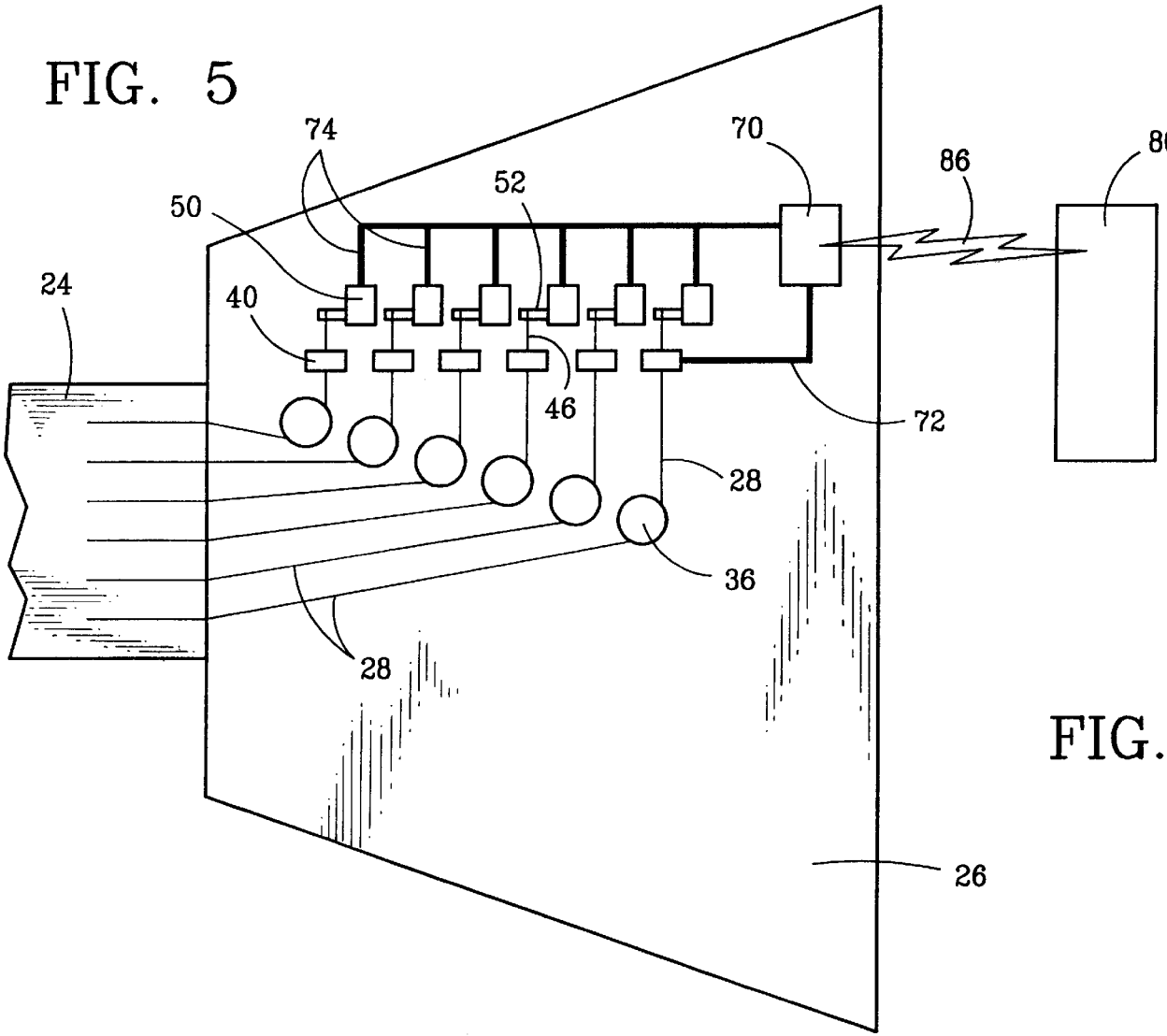
FIG. 5 is a schematic plan view of part of the instrument with elements of the tuning apparatus.

Referring now to the drawings, FIG. 1 shows schematically a tuning apparatus 10 for a musical instrument 20 which, as shown in FIGS. 2 and 3, has a body 22, a neck 24, a head 26 and a plurality of strings 28. Each string 28 is affixed to the body 22 by an anchor 30, then passes over a bridge 32, and extends without contact along the length of the neck 24 until it passes over a nut 34. The bridge 32 and the nut 34 provide critical contact points which define the effective length of the string 28 when it is set into vibration. As best seen in FIGS. 4 and 5, the string terminates (after changing direction if necessary at a point such as 36) at a tension-sensing device 40, which has on one side 42 an attachment point whereto the string 28 is fixedly but removably connected. The tension-sensing device 40 is preferably a strain gauge. An opposite side 44 of the tension-sensing device 40 has a second attachment point, whereto is fixedly attached a tuning string 46. This extends to a driver 50, where it is wound around a rotatable spindle 52.

The bridge 32 and the nut 34 are grooved at their points of contact with all the strings to preclude unintentional displacement of the strings. For clarity, the grooves are omitted from the drawings.

The schematic of FIG. 1 shows a microprocessor 70 that is electrically linked to the tension-sensing devices 40 by connector wires 72. Similar connector wires 74 link the microprocessor 70 to the drivers 50. FIG. 1 also shows connector wires 76 and 78 extending, respectively, from the microprocessor 70 to a computer 80, and from the computer 80 to a keyboard 82 or other input device.

FIG. 5 shows an embodiment that has a wireless connection 84 between the microprocessor 70 and the computer 80. As FIG. 5 shows, the microprocessor 70 can be conveniently positioned at some point on the surface of the head 24 of the instrument 20. For clarity, FIG. 5 shows only one of the connector wires 72 that link the microprocessor 70 with the tension-sensing devices 40.

As pointed out earlier, the bridge 32 and the nut 34 constitute critical contact points. Their distance apart determines the effective length of the string in determining the pitch. However, during a musical performance an instrumentalist can depress any of the strings with a finger until it contacts any of several frets 90 along the neck 24. This changes the effective length of the string and therefore its pitch. However, the pitch of the string is still subject to its tension as well as to its effective length.

Figure 6:
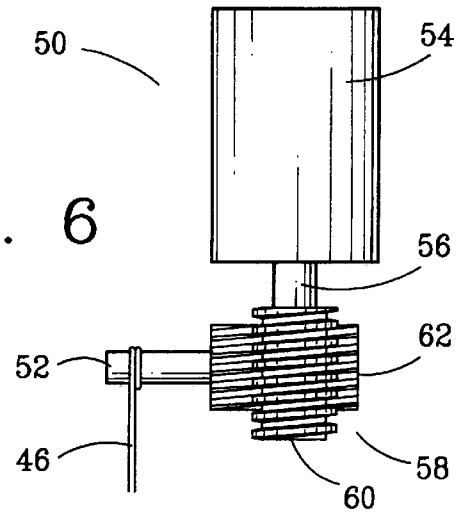
FIG. 6 is a schematic plan view of a driver including a motor and a worm drive.

The tuning apparatus operates as follows. The microprocessor 70 is commanded to activate by a signal from the computer 80 in response to user input at the keyboard 82. A signal from the tension-sensing device 40 is received as input by the microprocessor 70 and passed to the computer 80. The information from the tension-sensing device 40 is compared with a reference value stored in the computer 80 and if any difference is detected, an appropriate command is fed back to the microprocessor 70, which then causes the driver 50 to activate and change the tension in the string accordingly. As shown in FIG. 6, the driver 50 includes an electric motor 54 with a driveshaft 56 and a worm drive 58, which consists of a worm 60 which engages with a gear wheel 62. In turn, the gear wheel 62 is axially connected with the spindle 52 around which the tuning string 46 is wound.

Worm drives of the type described have two well-known attributes. First, they are an extremely effective reduction mechanism, being capable of providing a great reduction in speed and a correspondingly great mechanical advantage. Secondly, they are irreversible in the sense that while the worm can easily drive the gear, the gear cannot drive the worm. Both attributes are important to the present invention.

In particular, it can be seen that the motor 54 can easily adjust the tension of the instrument string 28 and the tuning string 46, but that the tension, once set, cannot be transmitted back to the motor 54. When the worm 60 is stationary, it precludes the gear 62 from rotating. Therefore, the pitch of the instrument string 28 is set until it either degrades from continued use or aging, or until it is intentionally readjusted.

In another embodiment, the strings themselves may be used as the tension-sensing devices. This would depend on the strings having an electrical conductivity that changes with tension. A voltage would be imposed across an element of each string between two unchanging reference points to produce an electrical current depending on the resistance, providing a measure of the resistance and thus of the tension. The current would be much smaller than would be obtained from a strain gauge and would likely have to be electrically amplified to be readily detectable; an electrical amplifier coupled to a current detector coupled to the string would be connected to the microprocessor in the same manner as the strain gauges.

The tuning apparatus may be used on an intermittent basis, between musical performances, or it may be used during a performance to vary the pitch of one or more strings on demand when required to produce special effects. Furthermore, the tuning apparatus may be use on multiple instruments; each instrument would be independently tunable, with its own wired or wireless channel of communication to the computer.

Obviously, some source of power must be provided for the drive motors 54 and for the tension-sensing devices. For clarity, no power source is shown in the drawings. An external power lead may be provided. Alternatively, a power source may be provided on board the instrument in the form of one or more batteries or power packs.

The tuning apparatus described above may also find use in other applications. For example, on interaction with suitable software, the signal received by the computer can be used to transcribe to a different musical key a piece of music performed on the instrument.

While the foregoing description and figures are directed toward preferred embodiments of the present invention, it should be appreciated that numerous modifications can be made to the structure and orientation of the various components of the present tuning system without departing from the spirit and scope of the present invention. Accordingly, the foregoing description should be taken by way of illustration rather than by way of limitation as the present invention is defined by the claims set forth below.

What is claimed is:

1. A tuning apparatus for an instrument having a plurality of strings, comprising:

(a) a strain gauge connected to each string to produce a signal corresponding to a tension within the respective string;

(b) a tension-adjusting driver operably connected to each string for selectively varying the tension within the string; and (c) a microprocessor operably connected to the driver and the strain gauge for changing the tension in the string in response to a signal received from the strain gauge.

2. The tuning device of claim 1, further comprising a computer connected to the microprocessor, the computer being configured to selectably receive therefrom an input corresponding to a measured tension value, to compare the measured value with a previous value, and to send a tuning signal to the controller to change the tension accordingly.

3. A tuning apparatus for an instrument having a plurality of strings, comprising:

(a) a strain gauge connected to each of the strings for generating an electrical signal corresponding to a tension within the respective string;

(b) a corresponding variably disposable driver operably connected to each string for selectively adjusting the tension within the string;

(c) a microprocessor operably connected to each strain gauge to receive the signal therefrom, and operably connected to the driver so that it can provide a tuning signal thereto; and (d) a computer connected to the microprocessor, the computer being able to selectably receive therefrom an input corresponding to a measured tension value, to compare the measured value with a previous value, and to send a tuning signal to the controller to change the tension accordingly.

4. The apparatus of claim 3, wherein a tuning string provides the connection from the strain gauge to the driver and can be wound around a spindle thereof.

5. The apparatus of claim 4, wherein the disposition of the driver cannot respond to a change in the tension of the tuning string.

6. The apparatus of claim 5, wherein the spindle is driven by a worm drive.

7. A tuning apparatus for an instrument having a plurality of strings, comprising:

(a) a strain gauge connected to each of the strings for generating an electrical signal corresponding to a tension within the respective string;

(b) a corresponding tension-adjusting driver operably connected to the string for selectively varying the tension within each string;

(c) a controller operably connected to each strain gauge to receive the signal therefrom, and operably connected to the driver so that it can provide a tuning signal thereto; and (d) a computer having a wireless connection to the controller, the computer being able to selectably receive therefrom an input corresponding to a measured tension value, to compare the measured value with a previous value, and to send a tuning signal to the controller to change the tension accordingly.

8. The tuning apparatus of claim 7, where the computer is configured to receive inputs from a plurality of instruments, and provides signals to a plurality of instruments.

9. The tuning apparatus of claim 8, wherein the controller is configured to employ a plurality of communication channels corresponding to the plurality of instruments.

10. A tuning apparatus for an instrument having a plurality of electrically conductive strings, the apparatus comprising:

(a) an electrical signal generator attached to at least one string;

(b) a measuring device connected to the string that generates a signal corresponding to an electrical conductivity of the string;

(c) a tension-adjusting driver operably connected to the string for selectively varying the tension of the string; and (d) a controller operably connected to the driver and the measuring device for changing the tension in the string in response to a signal received from the measuring device.

11. The tuning apparatus of claim 10, further comprising a computer connected to the controller, the computer being configured to selectably receive therefrom an input corresponding to a measured value, to compare the measured value with a previous value, and to send a tuning signal to the controller to change the tension accordingly.

12. The tuning apparatus of claim 10, further comprising an amplifier operably connected to the measuring device.

* * * * *

UNITED STATES PATENT AND TRADEMARK OFFICE

CERTIFICATE OF CORRECTION

PATENT NO. : 6,278,047 B1
DATED : August 21, 2001
INVENTOR(S) : Cumberland, Todd It is certified that error appears in the above-identified patent and that said Letters Patent is hereby corrected as shown below:

Title page,
Item [74], *Attorney, Agent, or Firm* - Brian B. Shaw, Esq.;
Stephen B. Salai, Esq.; Harter, Secrest & Emery LLP Signed and Sealed this Ninth Day of April, 2002

*Attest:*

*Attesting Officer*

JAMES E. ROGAN
*Director of the United States Patent and Trademark Office*